US010808473B2

(12) United States Patent
Stoldt et al.

(10) Patent No.: US 10,808,473 B2
(45) Date of Patent: Oct. 20, 2020

(54) LOAD LIMITING TONG

(71) Applicant: FORUM US, INC., Houston, TX (US)

(72) Inventors: Frederik Stoldt, Hamburg (DE); Andre Vierke, Hamburg (DE)

(73) Assignee: FORUM US, INC., Houston, TX (US)

( * ) Notice: Subject to any disclaimer, the term of this patent is extended or adjusted under 35 U.S.C. 154(b) by 231 days.

(21) Appl. No.: 15/251,713

(22) Filed: Aug. 30, 2016

(65) Prior Publication Data

US 2018/0058161 A1 Mar. 1, 2018

(51) Int. Cl.
*E21B 19/16* (2006.01)

(52) U.S. Cl.
CPC ..... *E21B 19/166* (2013.01); *E21B 19/161* (2013.01)

(58) Field of Classification Search
CPC ... E21B 19/166; E21B 19/161; B25B 23/141; B25B 23/1427; B25B 23/14
See application file for complete search history.

(56) References Cited

U.S. PATENT DOCUMENTS 164,368 A * 6/1875 Fenton ..... B25B 13/5058 30/102
1,080,937 A 12/1913 Stephens
1,921,281 A * 8/1933 Carlson ..... E21B 19/161 269/129
1,924,389 A * 8/1933 Baash ..... E21B 19/161 81/128
2,122,760 A 7/1938 Scott et al.
2,272,610 A * 2/1942 Kreiger ..... B25B 23/1427 73/862.25
2,281,226 A * 4/1942 Boles ..... B23P 19/065 73/862.25
2,527,456 A 10/1950 Schmeling
2,650,070 A * 8/1953 Lundeen ..... E21B 19/164 81/57.18
2,756,592 A * 7/1956 Foster ..... G01L 5/06 73/862.25
2,879,680 A * 3/1959 Beeman ..... E21B 19/164 81/57.18
3,021,739 A * 2/1962 Grundmann ..... E21B 19/164 81/57.19
3,033,154 A * 5/1962 Weisel ..... E21B 19/166 116/67 R
3,368,396 A * 2/1968 Van Burkleo ..... E21B 19/166 73/862.23
3,722,331 A 3/1973 Radulescu
3,739,663 A * 6/1973 Wilms ..... E21B 19/164 81/57.39
4,137,758 A 2/1979 Rodland
(Continued)

FOREIGN PATENT DOCUMENTS

CA 2134878 A1 11/1993
CA 2778400 A1 11/2012
GB 1251125 A 10/1971

OTHER PUBLICATIONS

International Search Report and Written Opinion dated Jun. 19, 2017, corresponding to Application No. PCT/US2017/031350.

*Primary Examiner* — Hadi Shakeri
(74) *Attorney, Agent, or Firm* — Patterson & Sheridan, L.L.P.

(57) ABSTRACT

A load limiting device that limits and/or provides an indication when an amount of torque applied to a threaded tubular connection by a tong exceeds a predetermined amount.

19 Claims, 5 Drawing Sheets

(56) References Cited

U.S. PATENT DOCUMENTS

| | | | | |
|---|---|---|---|---|
| 4,202,208 | A | 5/1980 | Byrne, Jr. | |
| 4,289,021 | A * | 9/1981 | Nelson | B25B 23/142 73/862.25 |
| 4,501,335 | A | 2/1985 | Gann | |
| 5,369,382 | A * | 11/1994 | Arvanitis | H03H 9/542 310/365 |
| 6,745,646 | B1 * | 6/2004 | Pietras | E21B 19/163 81/57.19 |
| 2014/0009305 | A1 | 1/2014 | Schultz et al. | |

* cited by examiner

LOAD LIMITING TONG

BACKGROUND

Field

Embodiments disclosed herein relate to a tong for coupling and de-coupling threaded tubular connections during a rig operation utilized in the oil and gas industry. More specifically, embodiments disclosed herein relate to a load limiting device that limits and/or provides an indication when the amount of torque applied to the threaded tubular connection by the tong exceeds a predetermined amount.

Description of the Related Art

A manual tong is a tool commonly used in the oil and gas industry to make up or break out threaded tubular connections. During a rig operation, the tong is suspended above a rotary spider that is located in the rig floor. The tong has jaws that are moved into position about a pin end of a tubular and configured to provide a desired amount of torque to rotate the tubular relative to another tubular to threadedly couple the two tubulars together. A pull-line in the form of a cable or wire rope is typically utilized to secure the tong to a winch that is utilized to rotate the tong to apply the desired amount of torque to the pin end of the tubular.

Manual tongs are rated to apply specific torque values. However, many operators utilize tongs that are not rated for the torque needed to make-up or break out threaded tubular connections. For example, a tong rated for a maximum of 10,000 foot-pounds of torque may be utilized to couple or decouple tubulars that require more than 10,000 foot-pounds of torque. This results in a safety hazard as the tong may fail, the tubulars may not be tightened to the desired torque value, and/or the tubulars may not be fully coupled during a make-up operation or fully decoupled during a break out operation.

Therefore, there exists a need for a new and improved tong that prevents the safety hazards described above.

SUMMARY

In one embodiment, a tong for rotating a tubular comprises a lever body; a jaw assembly coupled to one end of the lever body; a load attachment device coupled to an opposite end of the lever body; and a load limiting device coupled to the load attachment device by a linkage, wherein the load limiting device is movable from a first operational state to a second operational state to limit an amount of torque applied to the tubular by the tong when the amount of torque exceeds a torque rating of the tong.

In one embodiment, a tong for rotating a tubular comprises a lever body; a jaw assembly coupled to one end of the lever body; a load attachment device coupled to an opposite end of the lever body; and a biasing member coupled to the load attachment device by a linkage, wherein the biasing member is movable from a first operational state to a second operational state to limit an amount of torque applied to the tubular by the tong when the amount of torque exceeds a torque rating of the tong.

In one embodiment, a method for rotating a tubular comprises gripping a tubular using a tong; rotating the tubular using the tong; and temporarily preventing rotation of the tubular when torque applied to the tubular by the tong exceeds a torque rating of the tong.

BRIEF DESCRIPTION OF THE DRAWINGS

To facilitate understanding, identical reference numerals have been used, where possible, to designate identical elements that are common to the figures. It is contemplated that elements disclosed in one embodiment may be beneficially utilized with other embodiments without specific recitation.

DETAILED DESCRIPTION

Embodiments of the disclosure include a tong for use during a rig operation in the oil and gas industry. The tong includes an integrated torque limiting device that causes the tong to limit the amount of torque applied to a tubular if a torque limit or rating of the tong is exceeded. According to one embodiment, the tong may be a manual tong that is pulled by a winch to apply torque to a tubular.

Figure 1:
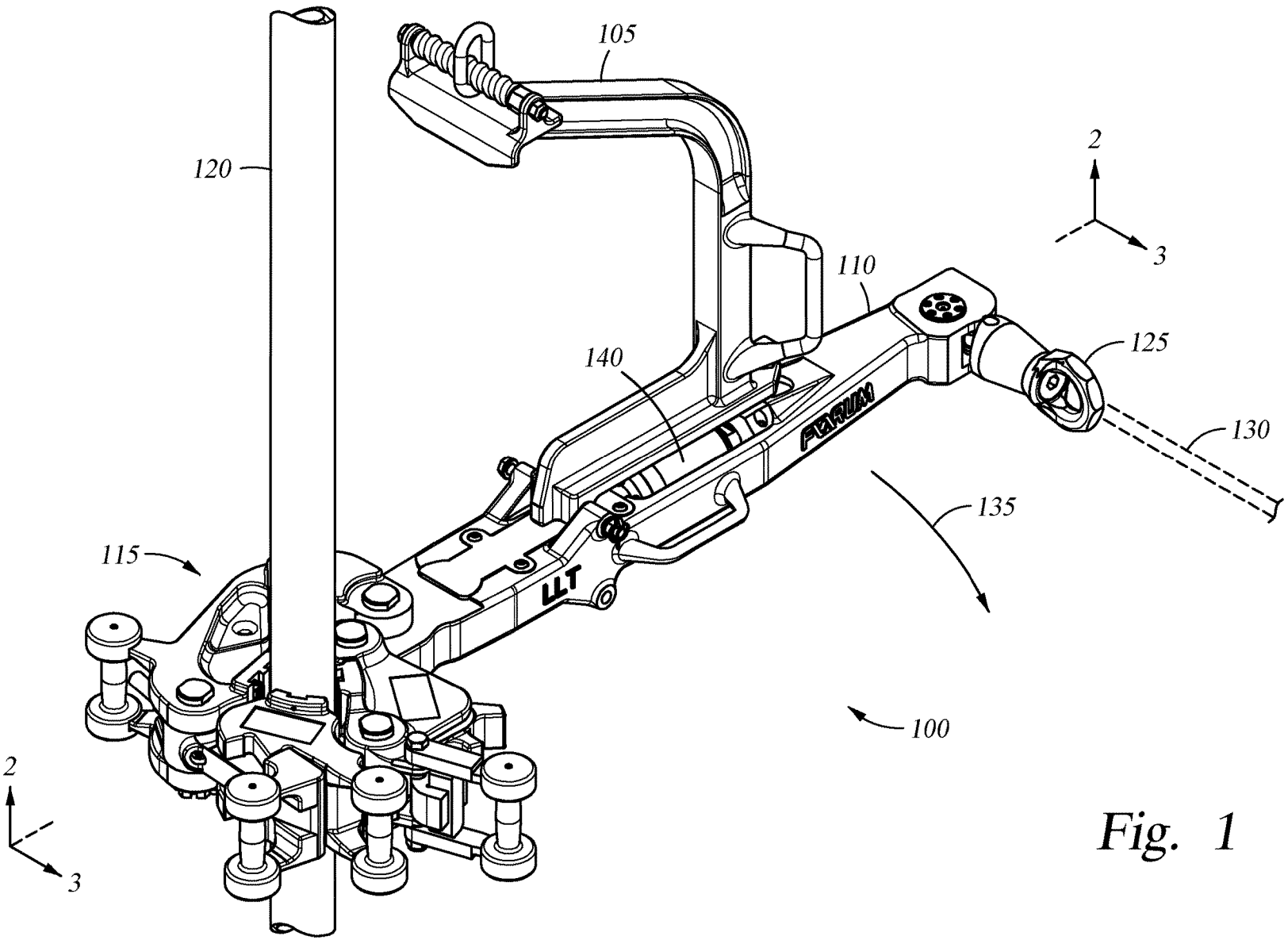
FIG. 1 is an isometric view of one embodiment of a tong having a load limiting device.

FIG. 1 is an isometric view of one embodiment of a tong 100. The tong 100 includes a hanger 105 that is coupled to a lever body 110. One end of the lever body 110 includes a jaw assembly 115 that grips a pin end of a tubular 120. The other end of the lever body 110 includes a load attachment device 125, such as an eyelet, that may be coupled to a cable 130. The cable 130 may be coupled to a pulling device, such as a winch, that applies a force to the lever body 110 in order to rotate the tong 100 in an axial direction identified by reference arrow 135.

The tong 100 also includes a load limiting device 140 positioned between the jaw assembly 115 and the load attachment device 125. The load limiting device 140 may be integrated with the tong 100, such as by being disposed within the lever body 110. The load limiting device 140 may be set and/or adjusted to render the tong 100 inoperable if a torque rating of the tong 100 is exceeded. For example, if the torque rating of the tong 100 is exceeded, the load limiting device 140 device may effectively limit the amount of torque that the tong 100 applies to the tubular 120.

Figure 2:
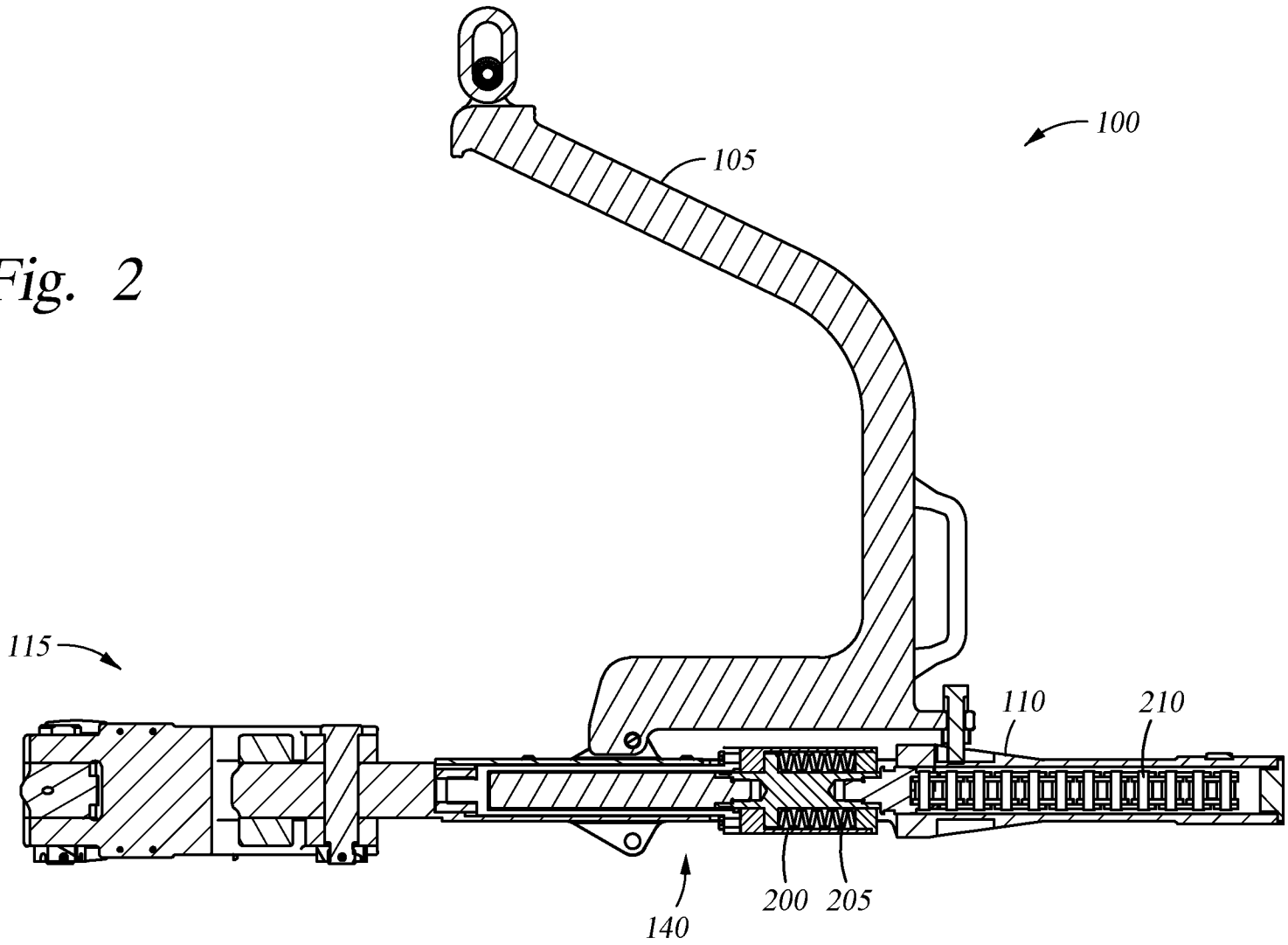
FIGS. 2 and 3 are cross-sectional views of the tong along lines 2-2 and 3-3, respectively, of FIG. 1.
Figure 3:
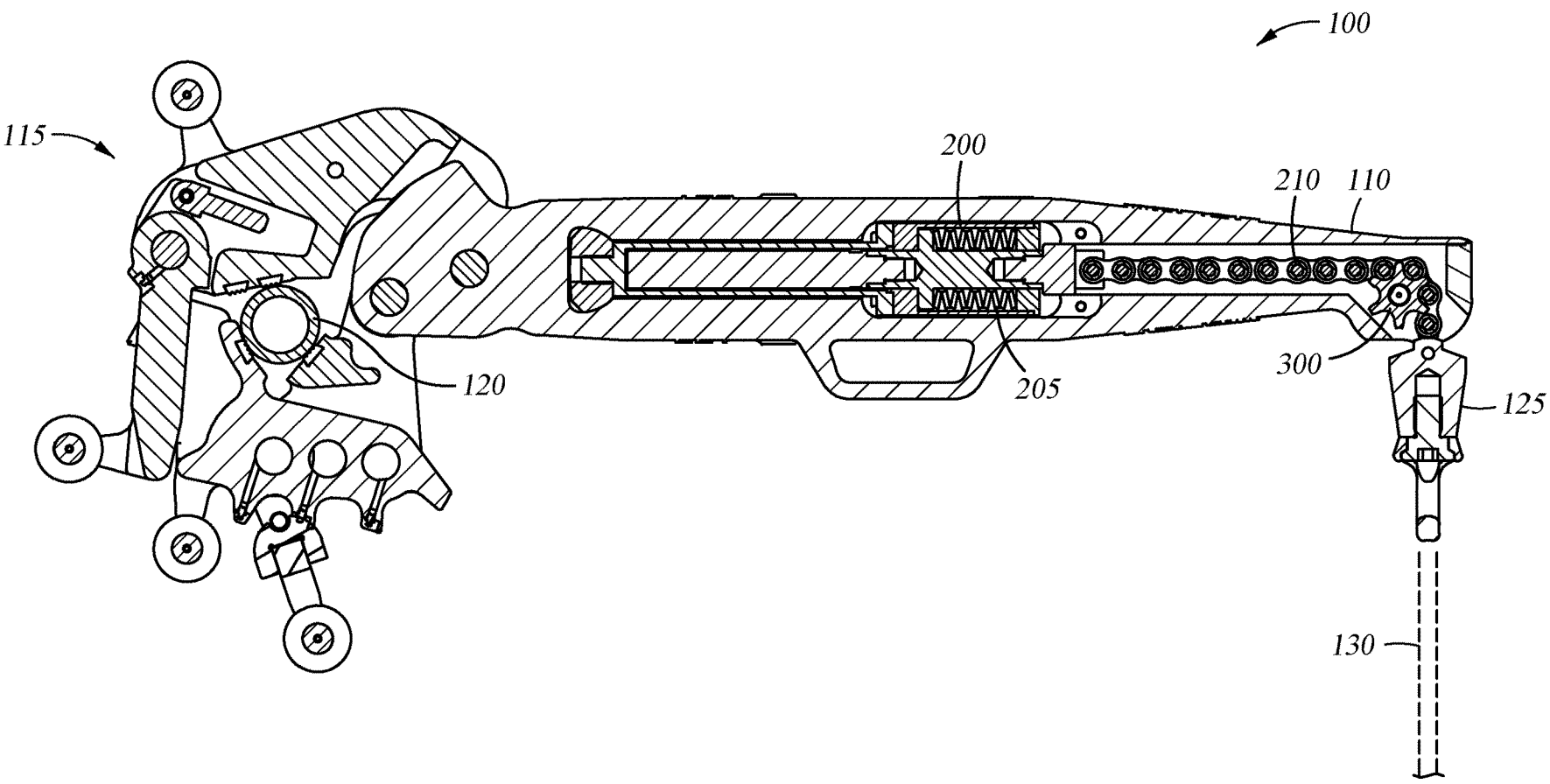

FIGS. 2 and 3 are cross-sectional views of the tong 100 taken along lines 2-2 and 3-3, respectively, of FIG. 1. The load limiting device 140 according to one embodiment includes a body 200 that houses a biasing member 205. The biasing member 205 may be one or more springs, discs, and the like. The biasing member 205 may be coupled to a linkage 210 that couples to the load attachment device 125 as shown in FIGS. 1 and 3. The linkage 210 may be a chain or cable that engages a deflection device 300 as shown in FIG. 3. The deflection device 300 is disposed between the load attachment device 125 and the load limiting device 140. The deflection device 300 may be a pulley or a sprocket that is coupled and rotatable relative to the lever body 110. The linkage 210 transfers the pulling force acting on the load attachment device 125 to the load limiting device 140 about the deflection device 300.

Figure 4:
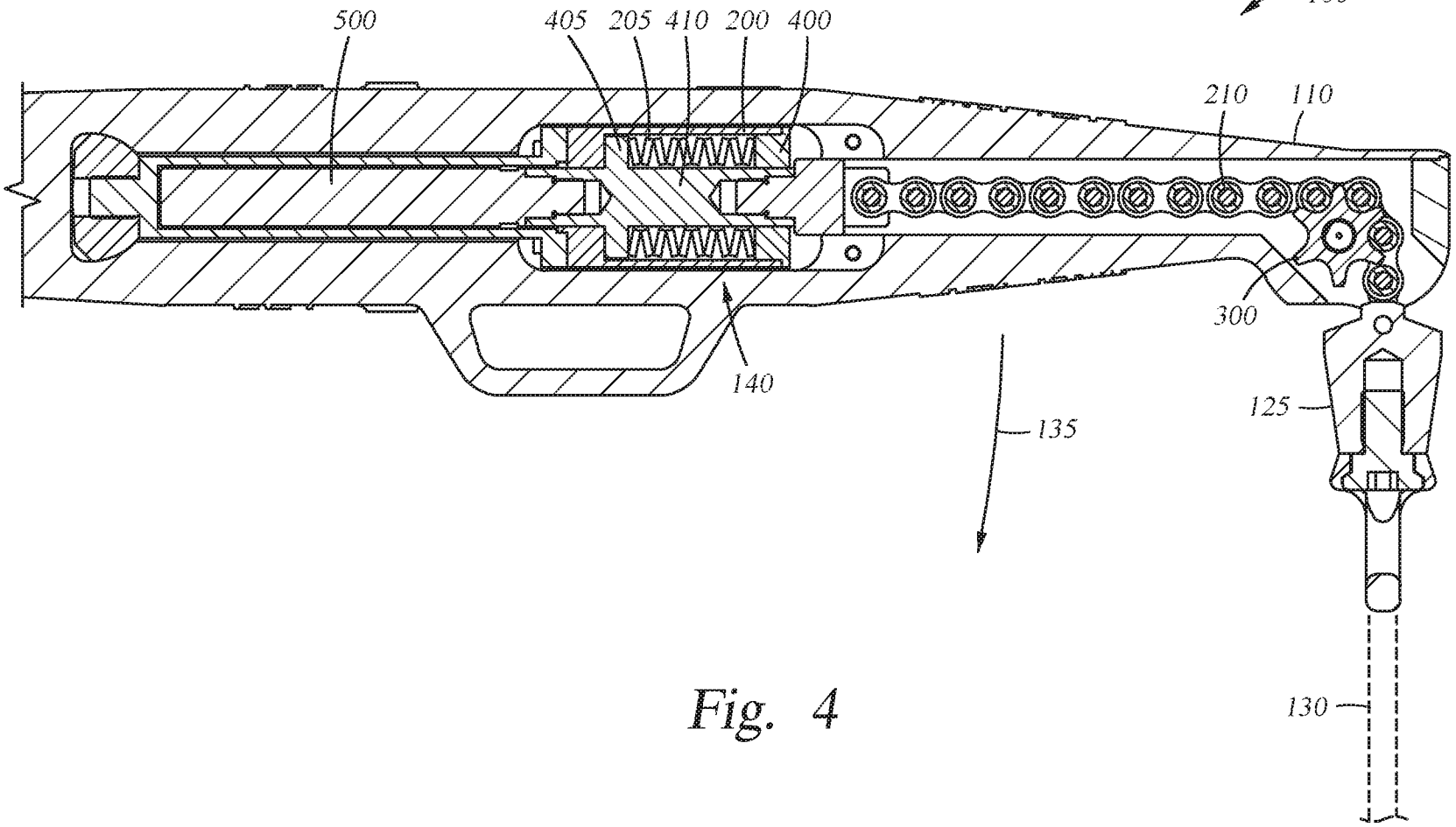
FIGS. 4 and 5 are enlarged cross-sectional views of the tong showing operation of the load limiting device.
Figure 5:
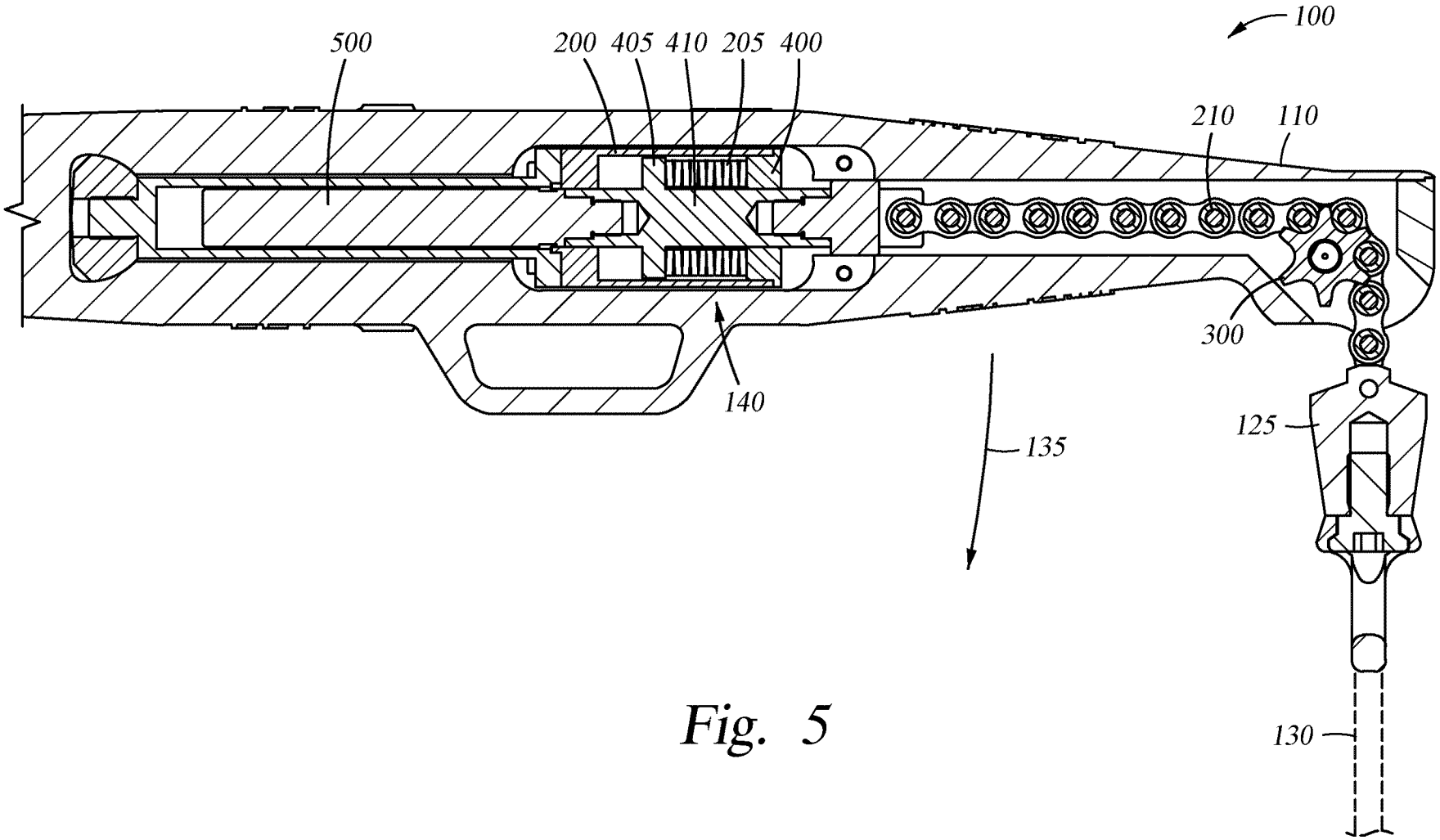

FIGS. 4 and 5 are enlarged cross-sectional views of the tong 100 showing operation of the load limiting device 140.

FIG. 4 shows the load limiting device 140 in a first operational state where the biasing member 205 is uncompressed or in a relaxed state. The biasing member 205 may be captured within the body 200 between a cap 400 and a shoulder 405 of a rod member 410 that is coupled to the linkage 210. The first operational state of the load limiting device 140 may be when a load is applied to the load attachment device 125 and the lever body 110 is moving in the axial direction identified by reference arrow 135 to rotate the tubular shown in FIG. 1. For example, if the tong 100 has a torque rating up to 10,000 foot-pounds of torque, and the applied torque does not exceed this torque rating, the tong 100 will operate to rotate the tubular with the load limiting device 140 in the first operational state as shown.

FIG. 5 shows the tong 100 in a second operational state when the applied torque by the tong 100 exceeds the torque rating of the tong 100. The biasing member 205 is compressed by the shoulder 405 of the rod member 410 when pulled by the linkage 210, which is at least partially pulled out of the lever body 110. This temporarily prevents the tong 100 from applying an amount of torque to the tubular 120 that exceeds the torque rating of the tong 100, and/or temporarily prevents further rotation of the tubular 120 by the tong 100. The movement of the linkage 210 and/or the tolling of rotation of the tubular 120 may provide visual indications to an operator that the maximum torque rating of the tong 100 has been exceeded. In addition, a torque indicator, for monitoring the torque in comparison with a greater amount of torque that an operator tries to apply to the tubular with the tong 100, may provide an indication that the maximum torque rating of the tong 100 has been exceeded.

The movement of the linkage 210 and/or the tolling of rotation of the tubular 120 may be temporary in some embodiments as the biasing member 205 may "bottom-out" between the cap 400 and the shoulder 405 of the rod member 410. When the biasing member 205 does bottom out, movement of the tong 100 may resume by applying a torque that exceeds the torque rating of the tong 100. However, the visual and/or torque indications should alert operators that the tong 100 may not be sufficient for the torque required to make-up or break-out the tubular 120. Further, the load limiting device 140 may be reset back to the first operational state when the force pulling on the linkage 210 via that load attachment device 125 falls below the rated torque value of the tong 100, as the biasing member 205 decompresses to a relaxed state and forces that rod member 410 back into the position shown in FIG. 4.

In some embodiments, the load limiting device 140 may include a support member 500 coupled to the rod member 410 that may be utilized as an additional biasing member and/or may be utilized as a shock absorber to prevent or minimize impact of the rod member 410 when returned back to the first operational state by the biasing member 205.

While the foregoing is directed to embodiments of the disclosure, other and further embodiments of the disclosure thus may be devised without departing from the basic scope thereof, and the scope thereof is determined by the claims that follow.

The invention claimed is:

1. A tong for rotating a tubular, comprising:

a lever body;

a jaw assembly coupled to one end of the lever body;

a load attachment device coupled to an opposite end of the lever body;

a cable coupled to the load attachment device; and a load limiting device comprising a rod member, a cap, and a biasing member disposed between the cap and a shoulder of the rod member, wherein the rod member, the cap, and the biasing member are each disposed within the lever body between the jaw assembly and the load attachment device, the rod member being biased into a first operational state by the biasing member and coupled to the load attachment device by a linkage disposed within the lever body, wherein the shoulder of the rod member is in contact with a wall disposed in the lever body in the first operational state, and the load attachment device is in contact with the lever body in the first operational state, the linkage being configured to pull the rod member from the first operational state to a second operational state to limit an amount of torque applied to the tubular by the tong when the amount of torque exceeds a torque rating of the tong, wherein the jaw assembly grips the tubular in the first operational state and the second operational state, wherein the shoulder of the rod member is movable toward the cap and away from the wall in the second operational state, an end of the linkage is pulled out of the lever body in the second operational state, and the load attachment devices is movable out of contact from the lever body in the second operational state, wherein the end of the linkage is coupled to the cable through the load attachment device.

2. The tong of claim 1, wherein the biasing member is a spring, and the load attachment device is an eyelet.

3. The tong of claim 1, wherein the biasing member is uncompressed in the first operational state.

4. The tong of claim 1, wherein the biasing member is compressed in the second operational state.

5. The tong of claim 1, wherein the linkage engages a deflection device disposed within the lever body between the load attachment device and the load limiting device.

6. The tong of claim 5, wherein the deflection device is a pulley or a sprocket that is coupled and rotatable relative to the lever body.

7. The tong of claim 1, wherein the load limiting device provides a visual indication to an operator when the load limiting device is in the second operational state.

8. The tong of claim 1, further comprising a support member coupled to the rod member and disposed between the jaw assembly and the rod member, wherein the support member is slidably disposed within the lever body, wherein the linkage is coupled to a first end of the rod member, and the support member is coupled to a second end of the rod member that is opposite of the first end of the rod member.

9. A tong for rotating a tubular, comprising:

a lever body;

a jaw assembly coupled to one end of the lever body;

a load attachment device disposed at an opposite end of the lever body;

a cable coupled to the load attachment device; and a cap disposed within the lever body between the jaw assembly and the load attachment device;

a rod member disposed within the lever body between the iaw assembly and the load attachment device, the rod member comprising a shoulder;

a biasing member disposed between the cap and the shoulder of the rod member and disposed within the lever body between the jaw assembly and the load attachment device, the biasing member being coupled to the load attachment device by a linkage disposed within the lever body, the linkage being configured to move the biasing member from a first operational state to a second operational state to limit an amount of torque applied to the tubular by the tong when the amount of torque exceeds a torque rating of the tong, wherein the biasing member is a spring, wherein the jaw assembly grips the tubular in the first operational state and the second operational state;

wherein in the first operational state:

the shoulder of the rod member is in contact with a wall disposed within the lever body, and the load attachment device is in contact with the lever body; and wherein in the second operational state:

the shoulder of the rod member is movable toward the cap and out of contact with the wall in the second operational state, an end of the linkage is pulled out of the lever body, the end of the linkage being coupled to the cable through the load attachment device, and the load attachment device moves out of contact from the lever body.

10. The tong of claim 9, wherein the biasing member is uncompressed in the first operational state.

11. The tong of claim 9, wherein the biasing member is compressed in the second operational state.

12. The tong of claim 9, wherein the linkage engages a deflection device disposed within the lever body between the load attachment device and the biasing member.

13. The tong of claim 12, wherein the deflection device is a pulley or a sprocket that is coupled and rotatable relative to the lever body.

14. The tong of claim 9, wherein the biasing member and the rod member are part of a load limiting device that provides a visual indication to an operator when the load limiting device is in the second operational state.

15. The tong of claim 9, further comprising a support member coupled to the rod member and disposed between the jaw assembly and the rod member, wherein the support member is slidably disposed within the lever body, wherein the linkage is coupled to a first end of the rod member, and the support member is coupled to a second end of the rod member that is opposite of the first end of the rod member.

16. A method for rotating a tubular, the method comprising:

gripping a tubular using a jaw assembly of a tong;

pulling on a load attachment device of the tong to rotate the tubular, the pulling on the load attachment device comprising pulling a cable coupled to the load attachment device;

rotating the tubular using the tong;

moving a load limiting device of the tong from a first operational state to a second operational state to temporarily prevent rotation of the tubular by compressing a biasing member disposed within a lever body of the tong between the jaw assembly and the load attachment device using a torque that exceeds a torque rating of the tong, wherein the biasing member is compressed between a cap and a shoulder of a rod member that is coupled to a linkage that pulls the rod member to compress the biasing member, the linkage being coupled to the load attachment device, wherein the cap, the rod member, and the linkage are disposed within the lever body of the tong, wherein the jaw assembly grips the tubular in the first operational state and the second operational state, wherein in the first operational state:

the shoulder of the rod member is in contact with a wall disposed within the lever body, the load attachment device is in contact with the lever body, and wherein in the second operational state:

the shoulder of the rod member is pulled toward the cap and out of contact with the wall in the second operational state, an end of the linkage is pulled out of the lever body in the second operational state, the end of the linkage being coupled to the cable through the load attachment device, and the load attachment device moves out of contact from the lever body; and temporarily preventing rotation of the tubular when torque applied to the tubular by the tong exceeds the torque rating of the tong.

17. The method of claim 16, wherein the biasing member is a spring.

18. The method of claim 17, wherein the biasing member is uncompressed when rotating the tubular.

19. The method of claim 16, wherein the moving the load limiting device of the tong from the first operational state to the second operational state comprises sliding a support member within the lever body of the tong, wherein the support member is coupled to the rod member and disposed between the jaw assembly and the rod member, the linkage is coupled to a first end of the rod member, and the support member is coupled to a second end of the rod member that is opposite of the first end of the rod member.

* * * * *